US011255344B2

(12) United States Patent
Mehlhorn et al.

(10) Patent No.: US 11,255,344 B2
(45) Date of Patent: Feb. 22, 2022

(54) PUMP DEVICE

(71) Applicant: Frideco AG, Neunkirch (CH)

(72) Inventors: Steve Mehlhorn, Laufenburg (CH); Lorenz Schneider, Schaffhausen (CH); Max Werthmueller, Schaffhausen (CH)

(73) Assignee: FRIDECO AG, Neunkirch (CH)

( * ) Notice: Subject to any disclaimer, the term of this patent is extended or adjusted under 35 U.S.C. 154(b) by 0 days.

(21) Appl. No.: 16/881,402

(22) Filed: May 22, 2020

(65) Prior Publication Data

US 2020/0370564 A1 Nov. 26, 2020

(30) Foreign Application Priority Data

May 24, 2019 (DE) ..... 10 2019 113 948.1

(51) Int. Cl.

| | |
|---|---|
| ***F04D 29/58*** | (2006.01) |
| ***F04D 3/00*** | (2006.01) |
| *F01P 3/20* | (2006.01) |
| *F01P 3/00* | (2006.01) |

(52) U.S. Cl.

CPC ..... *F04D 29/5866* (2013.01); *F04D 3/00* (2013.01); *F01P 3/20* (2013.01); *F01P 2003/001* (2013.01)

(58) Field of Classification Search

CPC ..... F04D 29/5866; F04D 29/586; F04D 3/00; F04D 13/06; F04D 13/08

See application file for complete search history.

(56) References Cited

U.S. PATENT DOCUMENTS

| | | | | |
|---|---|---|---|---|
| 3,450,056 A * | 6/1969 | Michael | F04D 13/0613 417/360 |
| 6,257,834 B1 | 7/2001 | Bremer et al. | |
| 6,416,281 B1 | 7/2002 | Bremer et al. | |
| 7,380,728 B2 * | 6/2008 | Augenstein | B60H 1/038 237/12.3 B |
| 2006/0275151 A1 * | 12/2006 | Heins | F04D 29/588 417/313 |
| 2021/0156392 A1 * | 5/2021 | Van-De-Velde | F04D 29/106 |

FOREIGN PATENT DOCUMENTS

| | | | | |
|---|---|---|---|---|
| DE | 1 703 433 A1 | 12/1971 | | |
| DE | 198 45 375 A1 | 4/2000 | | |
| DE | 10208688 A1 * | 9/2003 | | F04D 29/588 |
| DE | 10 2017 215 835 A1 | 3/2019 | | |
| DE | 10 2017 131 227 A1 | 6/2019 | | |
| EP | 0990800 A1 * | 4/2000 | | F04D 29/588 |

OTHER PUBLICATIONS

Office Action dated Mar. 11, 2020 issued in corresponding DE patent application No. 10 2019 113 948.1 (and English translation).

* cited by examiner

*Primary Examiner* — Richard A Edgar
*Assistant Examiner* — Jackson N Gillenwaters
(74) *Attorney, Agent, or Firm* — Posz Law Group, PLC

(57) ABSTRACT

A pump device, in particular an immersible pump device, includes at least one heat exchanger unit which is in at least one operation state configured for a heat exchange between a cooling fluid and a liquid that is to be pumped and which includes at least one cooling duct and at least one shaft receptacle having an axial direction, wherein a cross section surface area of the cooling duct changes by maximally 200% at least over a major portion of a course of the cooling duct.

16 Claims, 3 Drawing Sheets

PUMP DEVICE

CROSS REFERENCE TO RELATED APPLICATION

Figure 1:
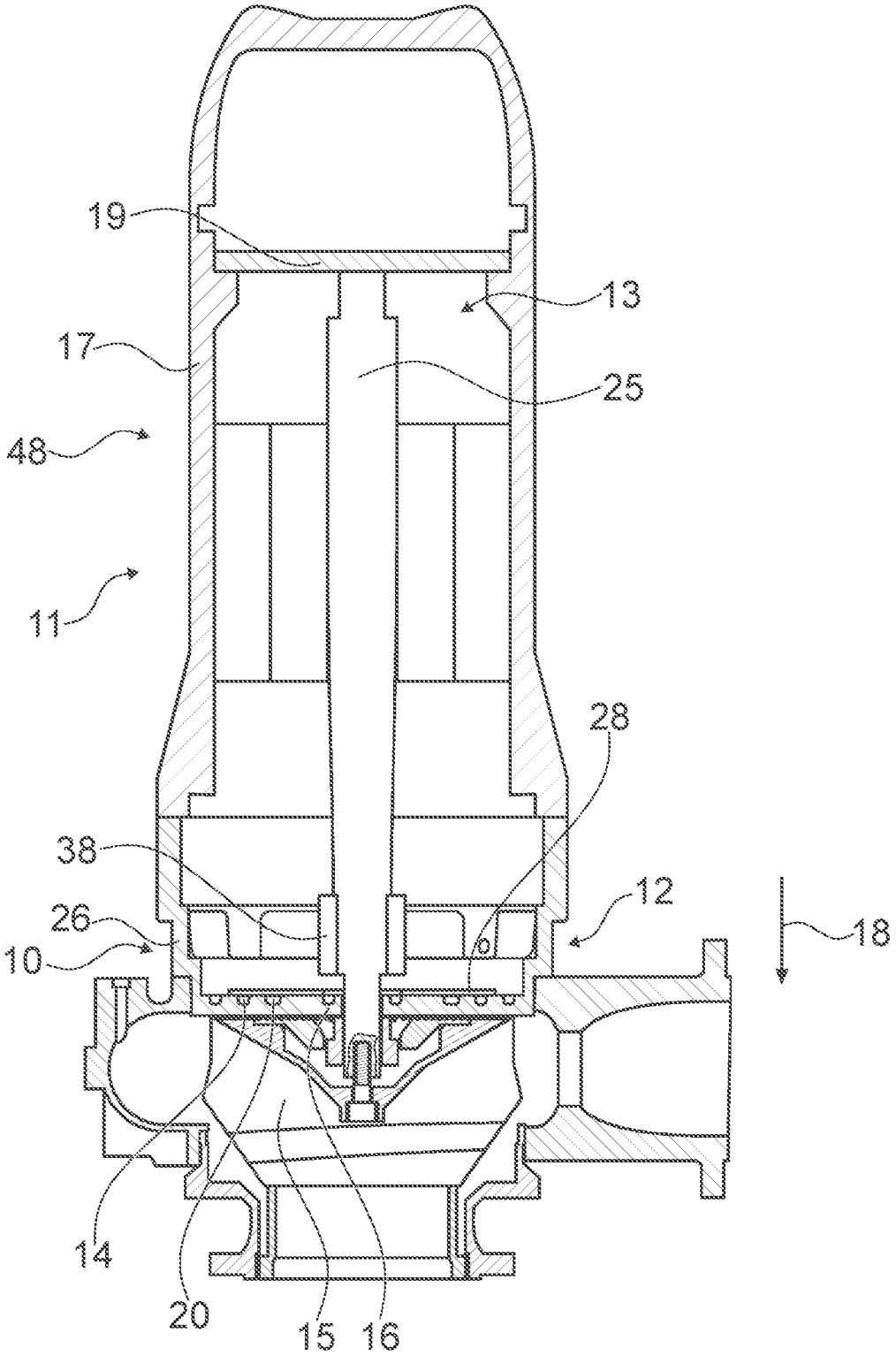

This application is based on and incorporates herein by reference German Patent Application No. 10 2019 113 948.1 filed on May 24, 2019.

STATE OF THE ART

The invention concerns a pump device according to the preamble of patent claim 1.

It has already been proposed to seal the engine bay of pumps by means of sealing plates which, for the purpose of a better cooling of the engine bay, comprise cooling ducts for receiving a cooling fluid.

The objective of the invention is in particular to provide a generic device with improved characteristics regarding heat exchange. The objective is achieved according to the invention by the features of patent claim 1, while advantageous implementations and further developments may be gathered from the dependent claims.

Advantages of the Invention

The invention is based on a pump device, in particular an immersible pump device, with at least one heat exchanger unit which is in at least one operation state configured for a heat exchange between a cooling fluid and a liquid that is to be pumped and which comprises at least one cooling duct and at least one shaft receptacle having an axial direction.

It is proposed that a cross section surface area of the cooling duct changes by maximally 200% at least over a major portion of a course of the cooling duct. The heat exchanger unit may in particular comprise a plurality of cooling ducts. This allows improving a heat exchange. In particular a homogeneous heat transfer is achievable from the cooling fluid to the liquid that is to be pumped. Advantageously it is possible that an optimum cross section surface area, permitting a high flow velocity of the cooling fluid and a large contact area for the heat transfer, to be at least substantially maintained over the major portion of the course. Especially advantageously a simple production of the heat exchanger unit is achievable.

By a "pump device" is in particular at least a component, in particular a subassembly, of a pump to be understood. In particular, the pump device may also comprise the entire pump. By a "pump", in particular an immersible pump, is in particular an appliance to be understood which in at least one operation state provides a movement of a liquid that is to be pumped and is preferably incompressible. Preferentially the pump device comprises a shell unit delimiting the pump to an outside, a drive shaft that is driven by an engine unit of the pump device, and/or a screw unit that is set to rotation in at least one operation state by the drive shaft, the rotation of the screw unit providing the movement of the liquid that is to be pumped. Alternatively the pump device may comprise a piston unit which is driven by an engine unit of the pump device and sets the liquid that is to be pumped in motion by a displacement process. Advantageously the engine unit is arranged within an engine bay of the pump that is delimited to an outside. The engine unit may in particular comprise an internal combustion engine. Especially advantageously the engine unit comprises an electromotor. In particular, in at least one operation state, the pump may be arranged outside and/or at least partially within or completely within the liquid that is to be pumped.

By a "heat exchanger unit" is in particular a unit to be understood that is configured to receive heat of at least one fluid and/or element and to transfer the heat to at least one other fluid and/or element. The heat exchanger unit in particular comprises at least one partial region forming at least one surface-area amplification structure. Advantageously the heat exchanger unit additionally comprises at least one plate-shaped element. A "plate-shaped element" is in particular meant to describe an element in which a smallest imaginary rectangular cuboid just still accommodating the element has a height that is equivalent to maximally 50%, in particular maximally 20%, advantageously maximally 10% and preferably maximally 5% of a length and width of the rectangular cuboid. Advantageously the plate-shaped element contributes to a definition of the cooling duct. Especially advantageously the heat exchanger unit contributes to a delimitation of the engine bay towards an outside. It would be conceivable that the heat exchanger unit is part of the shell unit. Preferably the heat exchanger unit is arranged at an end of the engine bay that faces towards the screw unit. Particularly preferably, in an assembled state the heat exchanger unit realizes a sealing connection together with the shell unit. It would be conceivable for the heat exchanger unit to be pressed and/or welded to the shell unit. The heat exchanger unit is preferably screwed to the shell unit. The heat exchanger unit preferentially comprises a material that is identical to a material of the shell unit. This in particular allows ensuring a good sealing of the engine bay at differing temperatures. In particular, the heat exchanger unit may comprise at least one, preferably rubber-like, sealing ring, which contributes to the sealing connection with the contact area of the shell unit. Particularly preferably the heat exchanger unit is embodied as a bottom plate of the engine bay.

By a "cooling fluid" is in particular a liquid to be understood which is configured to receive heat of at least one element and to transfer said liquid in particular to a further element, for example the heat exchanger unit. Preferably the cooling fluid has a high heat conductivity and/or heat capacity. Particularly preferably the cooling fluid has a viscosity that allows the cooling fluid to be pumped. It is conceivable that the cooling fluid is identical to the pumped medium, however preferentially the cooling fluid is different from the pumped fluid and is specifically configured for a cooling of the pump. Cooling fluids may, for example, contain water and/or oils.

By a "cooling duct" is in particular a contiguous volume to be understood which in at least one operation state a cooling fluid flows through. Advantageously a continuous deepening, in particular a groove, of the heat exchanger unit contributes to a definition of the cooling duct. The deepening in particular defines a duct wall delimiting the cooling duct towards the heat exchanger unit. Preferentially, over a major portion of the course, the duct wall has a cross section that is largely oval or round. By a "largely oval or round cross section" is in particular to be understood, in this context, that it is possible for at least 60%, advantageously at least 70%, preferably at least 80% and particularly preferably at least 90% of the cross section of the duct wall to be covered by an oval or a circle without the oval or the circle intersecting with the duct wall. It would also be conceivable that the cooling duct is implemented as an outwardly open hollow space in the interior of the heat exchanger unit. In particular, the cooling duct comprises at least one entry opening and at least one exit opening, which preferably define a flow direction of a cooling fluid flowing through the cooling duct. The entry opening and the exit opening preferably have different radial distances from the shaft receptacle. Particularly preferably a radial distance from the entry opening to the shaft receptacle is greater than a radial distance from the exit opening to the shaft receptacle. Advantageously the cooling fluid flows within a cooling cycle, in which the cooling fluid flows from the shell unit into the entry opening, through the cooling duct and from the exit opening back into the shell unit. Preferentially the shell unit comprises cooling ducts, wherein a further exit opening of at least one cooling duct of the shell unit is fluidically connected with the entry opening and a further entry opening of at least one cooling duct of the shell unit is fluidically connected with the exit opening.

A "shaft receptacle" is in particular to mean a partial region of the heat exchanger unit that surrounds at least one opening of the heat exchanger unit through which the drive shaft can penetrate the heat exchanger unit. The shaft receptacle preferably at least substantially has a circular-disk shape. "At least substantially" is in particular to mean, in this context, that customary manufacturing tolerances are taken into account. Especially preferentially, viewed perpendicularly to the axial direction, the shaft receptacle is spaced apart from an outer contour of the heat exchanger unit in an at least substantially homogeneous manner. By an "axial direction" of the shaft receptacle is in particular a direction to be understood that is defined by the shaft receptacle and in which the shaft receptacle may be oriented in an assembled state. Preferentially the axial direction is the only possible direction in which the drive shaft can be oriented in the assembled state. Preferably the axial direction is oriented perpendicularly to a main extension plane of the shaft receptacle. By a "main extension plane" of an object is in particular a plane to be understood which is parallel to a largest side surface of a smallest imaginary rectangular cuboid that just still completely encloses the object, and which in particular extends through the center point of the rectangular cuboid. In particular, the drive shaft penetrates the shaft receptacle in the assembled state.

A "cross section surface area" is in particular to mean a surface area of a cross section of the cooling duct. By a "cross section" is in particular, in this context, a surface to be understood which is located entirely within the cooling duct and is oriented perpendicularly to the duct wall of the cooling duct. Preferably, viewed perpendicularly to the extension direction of the surface, the surface completely fills an interspace spanned by the duct wall.

A "major portion of a course of the cooling duct" is in particular to mean at least 60%, advantageously at least 70%, preferably at least 80% and particularly preferably at least 90% of the course of the cooling duct. It would be conceivable that the major portion of the course of the cooling duct comprises the entire cooling duct. Preferably the major portion of the course of the cooling duct is free of entry openings and/or exit openings of the cooling duct. By a "course of the cooling duct" is in particular a spatial extension of the cooling duct perpendicularly to the cross section surface of the cooling duct to be understood.

"Configured" is in particular to mean specifically designed and/or equipped. In particular, "configured" is not meant to describe a mere suitability. In particular, a unit that is configured to fulfill a task fulfills said task to an extent that satisfies an operator of an apparatus which the unit belongs to. By an object being configured for a certain function is in particular to be understood that the object fulfills and/or executes said certain function in at least one application state and/or operation state.

It would be conceivable that the cross section surface area of the cooling duct alternatingly decreases and increases over the major portion of the course of the cooling duct. To improve a flow velocity of the cooling fluid within the cooling duct, it is proposed that the cross section surface area of the cooling duct changes over the major portion of the course of the cooling duct irreversibly, if at all. By the cross section surface area changing "irreversibly" is in particular to be understood that, viewed along the course of the cooling duct, the cross section surface area changes such that it monotonically increase or monotonically decreases in one direction. Viewed from the entry opening to the exit opening of the cooling duct, the cross section surface area preferably changes such that it falls monotonically. Advantageously a steady increase of the flow velocity of the cooling fluid while flowing through the cooling duct is achievable. Especially advantageously a retention of the cooling fluid due to a sudden decrease of the flow velocity is avoidable.

It is further proposed that the cross section surface area of the cooling duct is at least substantially constant over the major portion of the course of the cooling duct. Advantageously the cooling duct has an at least substantially constant cross section shape over the major portion of the course of the cooling duct. By a "cross section shape" is in particular an outer contour of the cross section surface to be understood. The cross section shape could, for example, correspond to a cut-off circle or a cut-off oval. In this way it is in particular possible to further improve a homogenization of a heat transfer from the cooling fluid to the liquid that is to be pumped. Advantageously a production of the heat exchanger unit is further simplifiable.

Preferentially the heat exchanger unit comprises at least one further cooling duct wherein, over the major portion of the course of the cooling duct, a circular-arc-wise distance from the cooling duct to the further cooling duct, extending concentrically to a center point of the shaft receptacle, corresponds to at least 50%, in particular at least 100%, advantageously to at least 150% and preferably to at least 200% of a width of the cooling duct. A "circular-arc-wise distance extending concentrically to a point" is in particular to mean, in this context, a length of a section line that, viewed along the axial direction and in a section through the heat exchanger unit, with the course of the section corresponding to a circle around the point, realizes a spacing between the two cooling ducts. By a "width of the cooling duct" is in particular a length of the section line to be understood that connects two opposite-situated points of the duct wall to each other. This in particular allows improving a heat transfer via the heat exchanger unit. It is advantageously possible to ensure that the heat exchanger unit is able to receive a sufficient heat quantity of the cooling fluid and to transfer the heat to the liquid that is to be pumped.

It would be conceivable that the circular-arc-wise distance corresponds to more than 400% of the width of the cooling duct. Preferentially the heat exchanger unit comprises at least one further cooling duct, wherein a circular-arc-wise distance from the cooling duct to the further cooling duct, extending concentrically to a center point of the shaft receptacle, in particular corresponds to maximally 400%, in particular to maximally 350%, advantageously to maximally 300%, preferably to maximally 250% and particularly preferably to maximally 200% of a width of the cooling duct. This in particular allows improving a heat output of the cooling fluid. Advantageously it is possible to reach a balance of heat that is introducible by the cooling fluid and heat that is receivable by the heat exchanger unit.

In an alternative implementation the cooling duct could be implemented as an open cooling duct that is entirely defined by a groove of the heat exchanger unit. To improve a contacting of the heat exchanger unit by the cooling fluid, it is proposed that the heat exchanger unit comprises at least one sealing component and at least one cover element, which together define the cooling duct over the major portion of its course. By a "sealing component" is in particular an element of the heat exchanger unit to be understood which delimits the engine bay towards an outside. Preferentially the sealing component comprises the shaft receptacle. Preferably the sealing component comprises the deepening. By a "cover element" is in particular a plate-shaped element of the heat exchanger unit to be understood which defines the cooling duct together with the deepening. In particular, in an assembled state the cover element directly lies upon the deepening. Preferably at least two partial regions of the deepening extend beyond the cover element and define the entry opening and the exit opening. The cover element could be connected with the sealing component, for example, by a press fit and/or by a welding process. Preferentially the cover element is screwed to the sealing component. Advantageously it is possible to augment a pressure in the cooling duct which the cooling fluid is conveyed with, and thus the flow velocity of the cooling fluid in the cooling duct.

It would be conceivable that the cooling duct has a straight course. Preferably the cooling duct is curved along the major portion of its course. By the cooling duct being "curved" within a partial region is in particular to be understood that in the partial region the cooling duct is free of straight sections. The cooling duct in particular comprises a consistent change of direction within the entire partial region. This in particular allows improving a contacting of the heat exchanger unit by the cooling fluid. Advantageously it is possible that a contact area in which the cooling fluid and the heat exchanger unit contact each other is increased independently from the cross section surface area.

It would be possible that the cooling duct is curved alternatingly in different directions and comprises at least one inflection point. To achieve a space-saving implementation of the heat exchanger unit, it is proposed that the cooling duct is continuously curved along the major portion of its course. By the cooling duct being curved "continuously" within a partial region is in particular to be understood that the cooling duct is free of inflection points within said partial region. In an imaginary movement along the major portion of the course of the cooling duct, a direction of the course of the cooling duct preferably undergoes a steady rotation in one direction. By a "direction of the course of the cooling duct" is in particular a direction to be understood that extends perpendicularly to the cross section surface of the cooling duct. Advantageously an effective usage of construction space of the cooling ducts, and thus an increased contact area is achievable relative to the spatial extension of the heat exchanger unit.

Beyond this it is proposed that the cooling duct comprises at least one end region which, viewed along the axial direction, has a tangential orientation aiming at least substantially towards a center point of the shaft receptacle. By an "end region" of the cooling duct is in particular a partial region to be understood that comprises maximally 10%, advantageously maximally 5% and preferably maximally 2% of a spatial extension of the cooling duct and which is not directly adjacent to any further partial regions of the cooling duct along a direction of the course. By "tangential orientations" of a partial region are in particular two directions to be understood which are antiparallel to each other and parallel to a tangent that adjoins an outer contour of the end region. In particular, the end region is directly adjacent to the exit opening of the cooling duct. Preferably the cooling duct comprises at least one further end region that at least substantially tangentially meets an imaginary circle which just still encompasses the cooling duct and whose center point is identical to the center point of the shaft receptacle. By the end region meeting the imaginary circle "at least substantially tangentially" is in particular to be understood that an orientation of the end region, when meeting with the circle, has a deviation of maximally 20 degrees, advantageously maximally 15 degrees and preferentially maximally 10 degrees from a tangent at a meeting point with the circle. This in particular allows increasing a flow velocity of the cooling fluid in the cooling duct. Advantageously a reduction of flow velocity decreases due to friction losses is possible.

For the purpose of further improving the contacting of the heat exchanger unit by the cooling fluid, it is proposed that, viewed along the axial direction, the cooling duct is situated within a circle sector of a circle whose center point is identical to the center point of the shaft receptacle, the circle sector having a central angle of at least 20 degrees, in particular at least 40 degrees, advantageously at least 60 degrees and preferably at least 80 degrees. This in particular allows even further improving a contacting of the heat exchanger unit by the cooling fluid. It is advantageously possible to further increase a contact area in which the cooling fluid and the heat exchanger unit contact each other, independently from the cross section surface area.

It would be conceivable that the cooling duct winds spirally around the shaft receptacle. To augment an efficiency of the heat transfer from the cooling fluid to the heat exchanger unit, it is proposed that the heat exchanger unit comprises a plurality of cooling ducts which together have an at least 10-fold, in particular at least 15-fold, advantageously at least 20-fold and preferably at least 25-fold rotational symmetry with respect to the axial direction. It is advantageously possible that the cooling fluid is quickly conveyed away from the heat exchanger unit after the heat transfer.

Beyond this it is proposed that the cooling ducts are arranged at least substantially in a shape of an impeller. This in particular allows further improving a heat transfer from the cooling fluid to the liquid that is to be pumped. Advantageously a large contact area for the heat transfer, a high flow velocity of the cooling fluid, a great efficiency of the heat transfer and a great construction-space efficiency of the cooling ducts are achievable.

It would be conceivable that an additional engine unit pumps the cooling fluid through the cooling duct, or that the pump device comprises a cooling wheel, which is fixated on a half of the drive shaft facing away from the screw unit. Advantageously the pump device comprises a cooling wheel that is supported rotatably and is configured to transport the cooling fluid from an entry opening of the cooling duct through the cooling duct to an exit opening of the cooling duct. By a "cooling wheel" is in particular an element to be understood which is in the operation state configured to rotate and to transport the cooling fluid by way of the rotation. The cooling wheel in particular transports the cooling fluid from a half of the drive shaft facing towards the screw unit to a half of the drive shaft facing away from the screw unit. Preferably the cooling wheel is fixated on the drive shaft and rotates together with the drive shaft in at least one operation state. In particular the cooling wheel is fixated on a half of the drive shaft facing towards the screw unit. This in particular allows improving a flow behavior of the cooling fluid.

For the purpose of increasing an energy efficiency, it is proposed that a curvature direction of the cooling duct is identical to a rotational direction of the cooling wheel. By the curvature direction being "identical to a rotational direction" is in particular to be understood that in an imaginary movement from the entry opening to the exit opening, the direction of the course of the cooling duct undergoes a rotation whose rotational direction is identical to the rotational direction of the cooling wheel. Advantageously it is possible that a rotational impulse of the cooling fluid flowing through the cooling duct is at least partly transferred to the cooling wheel.

DRAWINGS

Further advantages will become apparent from the following description of the drawings. The drawings show an exemplary embodiment of the invention. The drawings, the description and the claims contain a plurality of features in combination. Someone skilled in the art will purposefully also consider the features individually and will find further expedient combinations.

Figure 2:
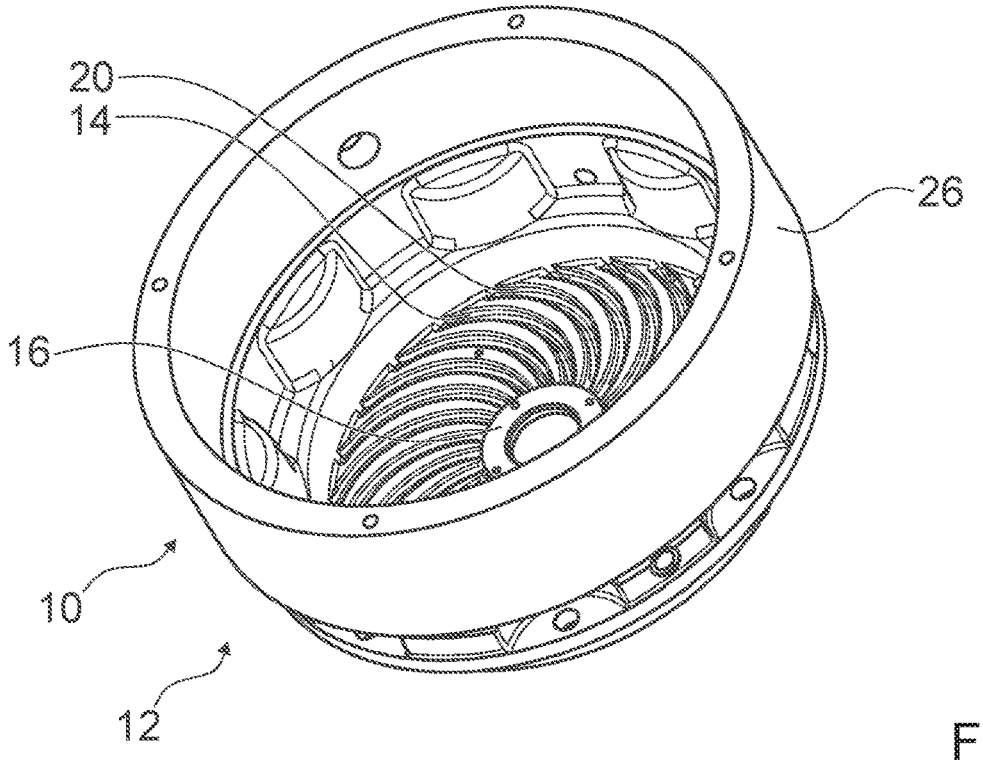
Figure 3:
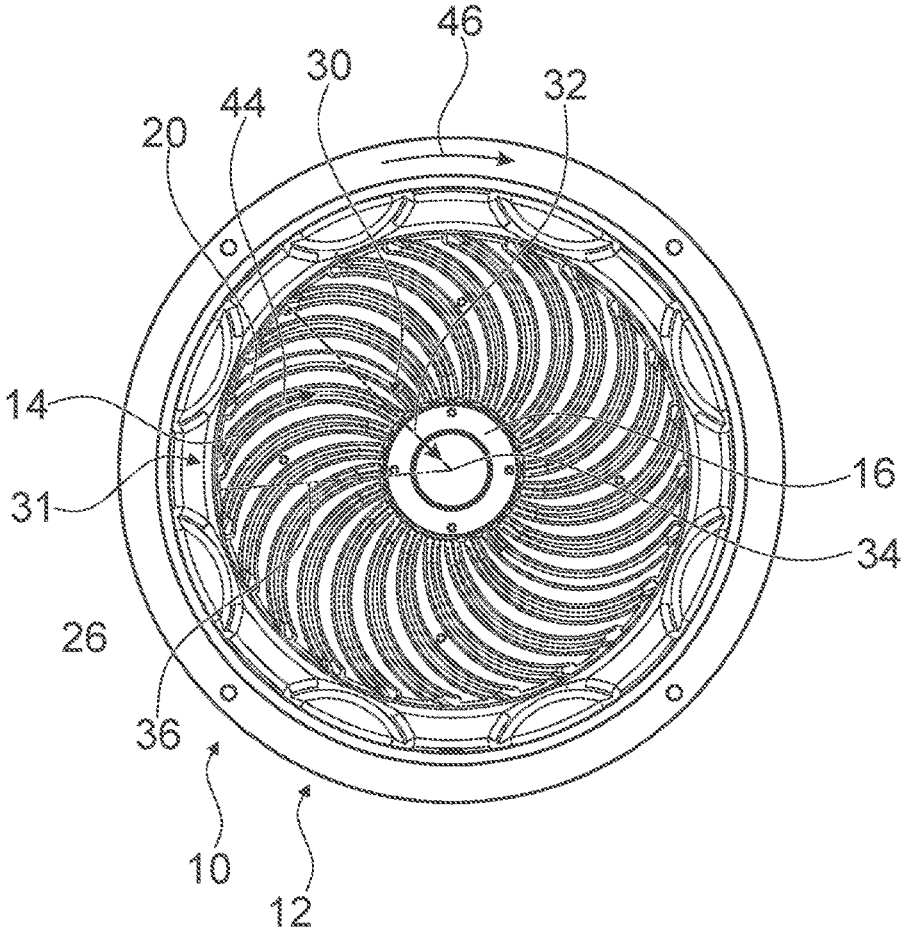
Figure 4:
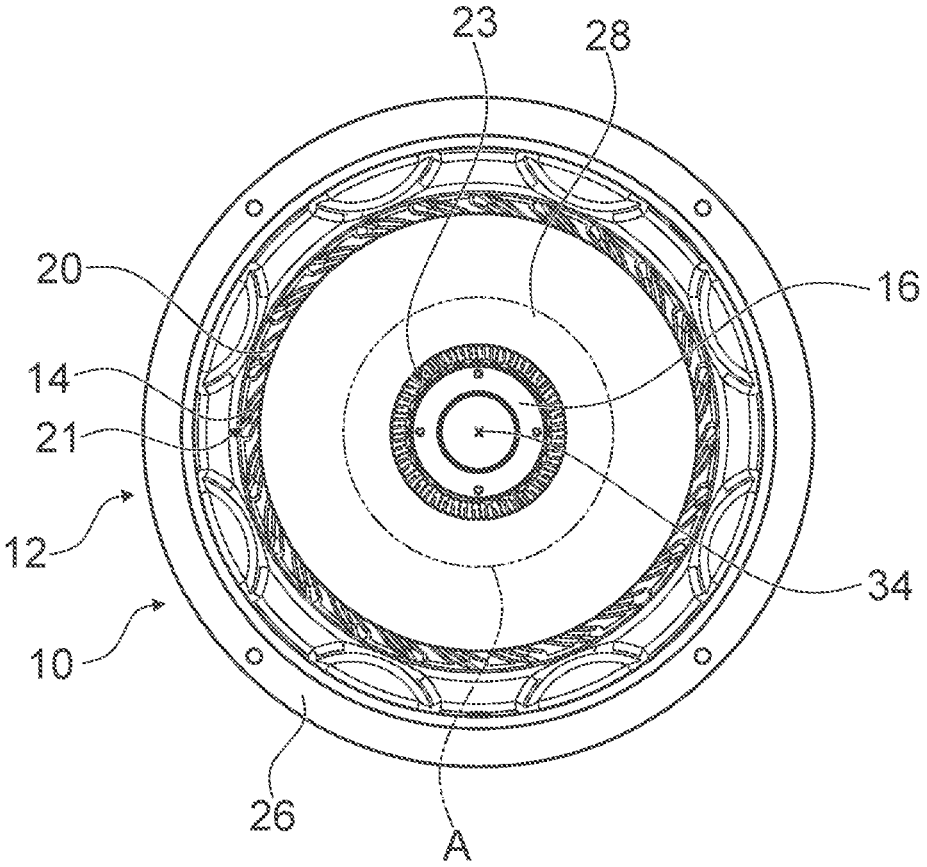
Figure 5:
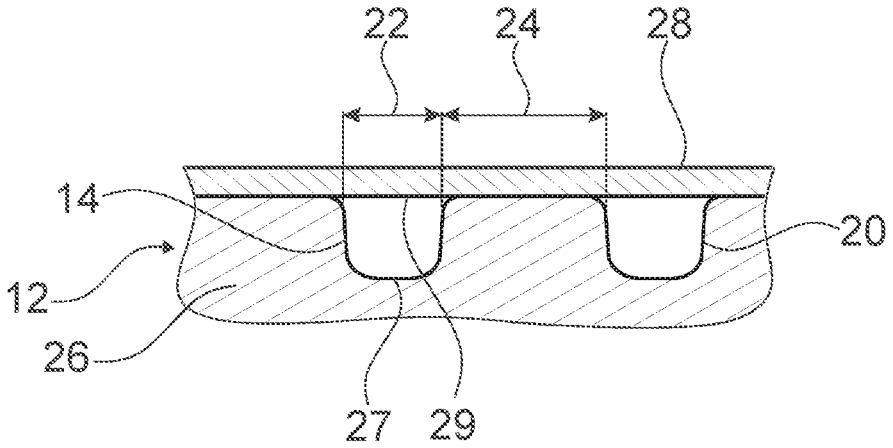

It is shown in:

FIG. 1 a schematic representation of a pump with a pump device in a cross-sectional view, FIG. 2 a schematic representation of a sealing component of the pump device in a diagonal view, FIG. 3 a schematic representation of the sealing component in a top view, FIG. 4 a schematic representation of a heat exchanger unit with the sealing component, in a top view, and FIG. 5 a schematic representation of two cooling ducts of the heat exchanger unit in a sectional view.

DESCRIPTION OF THE EXEMPLARY EMBODIMENT

FIG. 1 shows a pump 48 in a very simplified cross-sectional view. The pump 48 comprises an engine unit 11. The engine unit 11 is embodied as an electromotor.

Alternatively the engine unit 11 could be embodied as an internal combustion engine. The pump 48 comprises a drive shaft 25. In an operation state the engine unit 11 generates a rotation of the drive shaft 25. The drive shaft 25 is on one end connected with a screw unit 15. The screw unit 15 is configured to set a liquid that is to be pumped (not shown) in motion. In the operation state the screw unit 15 rotates together with the drive shaft 25. The pump 48 comprises an engine bay 13. The engine unit 11 is arranged entirely within the engine bay 13. The pump 48 comprises a shell unit 17. The shell unit 17 is bell-shaped. The shell unit 17 partially delimits the engine bay 13 towards an outside. The shell unit 17 comprises cooling ducts (not shown) for receiving a cooling fluid (not shown either). The shell unit 17 is made of cast-iron. Alternatively the shell unit 17 could be made of stainless steel and/or ceramic. The pump 48 comprises a bearing cover 19. The bearing cover 19 forms a ceiling of the engine bay 13 that faces away from the screw unit 15. The bearing cover 19 is made of a material that is identical to the material of the shell unit 17.

The pump 48 comprises a pump device 10. The pump device 10 comprises a heat exchanger unit 12. In the operation state the heat exchanger unit 12 is configured for a heat exchange between the cooling fluid and the liquid that is to be pumped. The heat exchanger unit 12 comprises a sealing component 26, which is depicted in detail in FIGS. 2 and 3. The sealing component 26 seals an opening of the shell unit 17 that faces towards the screw unit 15. The sealing component 26 forms a bottom of the engine bay 13 that faces towards the screw unit 15. The sealing component 26 is embodied in a bowl-shape. The sealing component 26 is made of a material that is identical to the material of the shell unit 17. The heat exchanger unit 12 comprises a cover element 28, which is shown in detail in FIG. 4. The cover element 28 is embodied in a plate shape. The cover element 28 is embodied in a circular-disk shape. The cover element 28 lies directly upon the sealing component 26. The cover element 28 is screwed to the sealing component 26.

The heat exchanger unit 12 comprises twenty-five cooling ducts. The cooling ducts together have a 25-fold rotational symmetry with respect to an axial direction 18. The cooling ducts are implemented in a shape of an impeller. The cooling ducts are implemented identically to one another and therefore, to provide a better overview, only a cooling duct 14 and a further cooling duct 20 are given reference numerals and will be described below. Alternatively the heat exchanger unit 12 could comprise only one cooling duct. The sealing component 26 and the cover element 28 together define the cooling duct 14. The sealing component 26 comprises a deepening that defines a duct wall 27 of the cooling duct 14. The duct wall 27 has a largely oval cross section over a major portion of the course. The cover element 28 lies over the deepening and defines a duct ceiling 29. A partial region of the deepening, which extends beyond the cover element 28 in an outer edge region, defines an entry opening 21 of the cooling duct 14. A partial region of the deepening, which extends beyond the cover element 28 in an inner edge region, defines an exit opening 23 of the cooling duct 14. The cooling fluid flows in a cooling cycle. The cooling fluid flows from the shell unit 17 into the entry opening 21. The cooling fluid flows through the cooling duct 14 and through the exit opening 23 back into the shell unit 17.

The heat exchanger unit 12 comprises a shaft receptacle 16. The shaft receptacle 16 is embodied as circle-disk-shaped partial region of the sealing component 26. The shaft receptacle 16 defines an inner edge of the heat exchanger unit 12. The shaft receptacle 16 has an axial direction 18. The drive shaft 25 is aligned along the axial direction 18. The drive shaft 25 penetrates the shaft receptacle 16.

A cross section surface area of the cooling duct 14 changes by approximately 20% over a major portion of a course of the cooling duct 14. Alternatively the cross section surface area could change by approximately 50% or approximately 100%. The cross section surface area of the cooling duct 14 changes irreversibly over the major portion of the course of the cooling duct 14. The cross section surface area of the cooling duct 14 monotonically decreases radially towards the shaft receptacle 16. Alternatively the cross section surface area of the cooling duct 14 could as well be consistent over the major portion of the course.

FIG. 5 shows the further cooling duct 20 together with the cooling duct 14 in a sectional view. The sectional view corresponds to a circular section along the section line A, wherein the section area has been unfolded to form a plane. The section line A corresponds to a circle whose center point is identical to a center point 34 of the shaft receptacle 16. The further cooling duct 20 is arranged adjacently to the cooling duct 14. The further cooling duct 20 is identical to the cooling duct 14 in regard to all further features. A circular-arc-wise distance 24 between the cooling duct 14 and the further cooling duct 20, extending concentrically to a center point 34 of the shaft receptacle 16, over the major portion of the course of the cooling duct 14 corresponds to approximately 150% of a width 22 of the cooling duct 14. Alternatively the circular-arc-wise distance 24 could also correspond to 50% or 400% of the width 22.

The cooling duct 14 is continuously curved along the major portion of its course. Alternatively the cooling duct 14 could section-wise extend straight and/or have differing curvature directions. The cooling duct 14 comprises an end region 30. The end region 30 borders on the exit opening 23 of the cooling duct 14. Viewed along the axial direction 18, the end region 30 has a tangential orientation 32. The tangential orientation 32 essentially extends towards a center point 34 of the shaft receptacle 16. The cooling duct 14 comprises a further end region 31. The further end region 31 borders on the entry opening 21 of the cooling duct 14. To a large extent, the further end region 31 tangentially meets with a circle (not shown) whose center point is identical to the center point 34 and which just still accommodates the cooling duct 14.

When viewed along the axial direction 18, the cooling duct 14 is situated within a circle sector 36 of the circle. The circle sector 36 has a central angle (not shown) of approximately 45 degrees. Alternatively the circle sector 36 could have a central angle of 90 degrees.

The pump device 10 comprises a cooling wheel 38. The cooling wheel 38 is movably supported. The cooling wheel 38 is fixated on a half of the drive shaft 25 that faces towards the screw unit 15. Alternatively the pump device could comprise one cooling wheel or a plurality of cooling wheels, which might be fixated on a half of the drive shaft 25 that faces away from the screw unit 15. The cooling wheel 38 is configured for a transport of the cooling fluid from the entry opening 21 of the cooling duct 14 through the cooling duct 14 to the exit opening 23 of the cooling duct 14. A curvature direction 44 of the cooling duct 14 is identical to a rotational direction 46 of the cooling wheel 38.

REFERENCE NUMERALS

10 pump device
11 engine unit
12 heat exchanger unit
13 engine bay
14 cooling duct
15 screw unit
16 shaft receptacle
17 shell unit
18 axial direction
19 bearing cover
20 cooling duct
21 entry opening
22 width
23 exit opening
24 circular-arc-wise distance
25 drive shaft
26 sealing component
27 duct wall
28 cover element
29 duct cover/ceiling
30 end region
31 end region
32 tangential orientation
34 center point
36 circle sector
38 cooling wheel
44 curvature direction
46 rotational direction
48 pump

The invention claimed is:

1. A pump device, in particular an immersible pump device, with at least one heat exchanger unit which is in at least one operation state configured for a heat exchange between a cooling fluid and a liquid that is to be pumped and which comprises at least one cooling duct and at least one shaft receptacle having an axial direction, wherein a cross section surface area of the cooling duct changes by maximally 200% at least over a major portion of a course of the cooling duct, the heat exchanger unit comprises at least one further cooling duct, over the major portion of the course of the cooling duct, a circular-arc-wise distance from the cooling duct to the further cooling duct, extending concentrically to a center point of the shaft receptacle, corresponds to at least 50% of a width of the cooling duct, and the further cooling duct is arranged adjacently to the cooling duct.

2. The pump device according to claim 1, wherein the cross section surface area of the cooling duct changes over the major portion of the course of the cooling duct irreversibly, if at all.

3. The pump device according to claim 1, wherein the cross section surface area of the cooling duct is at least substantially constant over the major portion of the course of the cooling duct.

4. The pump device according to claim 1, wherein the heat exchanger unit comprises at least one further cooling duct wherein, over the major portion of the course of the cooling duct, a circular-arc-wise distance from the cooling duct to the further cooling duct, extending concentrically to a center point of the shaft receptacle, corresponds to maximally 400% of a width of the cooling duct.

5. The pump device according to claim 1, wherein the heat exchanger unit comprises at least one sealing component and at least one cover element, which together define the cooling duct over the major portion of its course.

6. The pump device according to claim 1, wherein the cooling duct is curved along the major portion of its course.

7. The pump device according to claim 6, wherein the cooling duct is continuously curved along the major portion of its course.

8. The pump device according to claim 6, wherein a curvature direction of the cooling duct is identical to a rotational direction of the cooling wheel.

9. The pump device according to claim 1, wherein the cooling duct comprises at least one end region which, viewed along the axial direction, has a tangential orientation aiming at least substantially towards a center point of the shaft receptacle.

10. The pump device according to claim 1, wherein viewed along the axial direction, the cooling duct is situated within a circle sector of a circle whose center point is identical to a center point of the shaft receptacle, the circle sector having a central angle of at least 20 degrees.

11. The pump device according to claim 1, wherein the heat exchanger unit comprises a plurality of cooling ducts which together have an at least 10-fold rotational symmetry with respect to the axial direction.

12. The pump device according to claim 11, wherein the cooling ducts are arranged at least substantially in a shape of an impeller.

13. The pump device according to claim 1, further comprising at least one cooling wheel, which is supported rotatably and is configured to transport the cooling fluid from an entry opening of the cooling duct through the cooling duct to an exit opening of the cooling duct.

14. A pump, in particular an immersible pump, with a pump device according to claim 1.

15. The pump device according to claim 1, wherein the circular-arc-wise distance extending concentrically to a point is a length of a section line that, viewed along the axial direction and in a section through the heat exchanger unit, with the course of the section corresponding to a circle around the point, realizes a spacing between the cooling ducts and the further cooling duct.

16. The pump device according to claim 1, wherein the width of the cooling duct is a length of a section line that connects two opposite-situated points of a cooling duct wall to each other.

* * * * *